United States Patent [19]

Surjaatmadja

[11] 4,434,704

[45] Mar. 6, 1984

[54] HYDRAULIC DIGITAL STEPPER ACTUATOR

[75] Inventor: Jim B. Surjaatmadja, Duncan, Okla.

[73] Assignee: Halliburton Company, Duncan, Okla.

[21] Appl. No.: 140,126

[22] Filed: Apr. 14, 1980

[51] Int. Cl.[3] ..... F15B 15/22

[52] U.S. Cl. ..... 91/25; 91/39; 91/409; 91/422; 137/624.2

[58] Field of Search ..... 91/39, 19, 20, 357, 91/408, 445, 392, 25, 409, 422; 137/624.2, 625.13

[56] References Cited

U.S. PATENT DOCUMENTS

| | | | |
|---|---|---|---|
| 1,329,572 | 2/1920 | Adam | 91/19 |
| 2,751,752 | 6/1956 | Metcalf . | |
| 3,114,297 | 12/1963 | Gizeski . | |
| 3,164,065 | 1/1965 | Frantz | 91/365 |
| 3,246,572 | 4/1966 | Ogilvie | 91/357 |
| 3,593,617 | 7/1971 | Butterworth | 91/408 |
| 3,732,027 | 5/1973 | Lupke | 91/445 |
| 3,779,136 | 12/1973 | Hohlein | 91/361 |
| 4,014,248 | 3/1977 | Cyrot | 91/19 |
| 4,106,390 | 8/1978 | Kodaira | 91/42 |
| 4,114,513 | 9/1978 | Debrus | 91/19 |
| 4,152,971 | 5/1979 | Leonard | 91/388 |

FOREIGN PATENT DOCUMENTS

| | | | |
|---|---|---|---|
| 2726350 | 12/1977 | Fed. Rep. of Germany | 91/39 |

*Primary Examiner*—Abraham Hershkovitz
*Attorney, Agent, or Firm*—E. Harrison Gilbert, III; Joseph A. Walkowski; Thomas R. Weaver

[57] ABSTRACT

An apparatus for converting pressure into motion includes a housing having a plurality of ports formed therein. Movably disposed within the housing is a piston having a first plurality of apertures communicating with a first chamber and a second plurality of apertures communicating with a second chamber therein. The piston is positioned within the housing so that the apertures can register with consecutive ones of the ports as the piston is moved in either of two directions within the housing. The movable member is moved by a pressurizing substance applied to a selectable one of the ports through an appropriate valve circuit. The valve circuit is operated by excitation signals from a control member. By operating the valve circuit in an appropriate sequence, the pressurizing substance is sequentially applied to consecutive ones of the ports to move the piston longitudinally through the housing.

8 Claims, 7 Drawing Figures

HYDRAULIC DIGITAL STEPPER ACTUATOR

This invention relates generally to apparatus for converting pressure into motion and more particularly, but not by way of limitation, to linear actuator apparatus which convert pressure into predetermined increments of linear displacement.

Precise control of linear movement is often required for meeting manufacturing specifications in machine tool applications and material handling applications. For example, when cutting a workpiece on a lathe, the cutting tool often needs to be moved in specific increments with respect to the workpiece to make the appropriate cut at the proper place along the length of the workpiece. This requires an apparatus which can move the workpiece and the tool in specific increments with respect to each other.

Such an apparatus might include a cylinder having a double-acting piston slidably positioned therein for bidirectional movement with respect thereto in response to an application of pressure to one side or the other of the piston. Examples of devices having double-acting pistons movable in response to pressure inputs are shown in U.S. Pat. No. 4,152,971 in the name of Leonard, U.S. Pat. No. 4,106,390 in the name of Kodaira et al., U.S. Pat. No. 3,779,136 in the name of Hohlein and U.S. Pat. No. 2,751,752 in the name of Metcalf. Although these references disclose apparatus having double-acting piston, they do not disclose apparatus which meet specific desirable needs for achieving accurate and repeatable control of incremental movements.

These needs include providing an apparatus which can accomplish precise, repeatable incremental movement independently of the magnitude of a pressure applied to a movable member which is to be displaced the specified increment. This obviates the need for correlating the applied pressure with the distance the movable member is to be moved. In other words, it is desirable to construct an apparatus which includes a plurality of ports through which a pressurizing substance can be applied whereby the movement to be achieved by such apparatus is dependent on the present position of the movable member therein and the port through which the pressurizing substance is applied to the movable member.

It is also desirable that such an apparatus for precisely controlling movement not require electrical feedback to the primary controlling means so that no electrical oscillatory control signals are generated. To achieve precise control without primary control feedback, there is the need for the apparatus to include a set of interrelated ports and openings in the apparatus to precisely position the movable member through the application of a pressurizing substance therethrough. To compensate any overshoot of the movable member which might occur, it is necessary to include in the apparatus a pressure feedback means to properly stop the movable member at the predetermined location.

So that the precise movements can be controlled without feedback to the main controller, there is the need for control means for generating a cyclical sequence of electrical control signals, such as a Gray Code sequence of digital signals, for uniformly moving the movable member in specific increments. It is also desirable to provide the sequence of electrical control signals at varying rates so the speed at which the movable member is moved may also be varied.

A further need is for the movable member to be moved with variable magnitudes of forces so that various levels of forces can be exerted by the movable member on the object which it is positioning.

The present invention overcomes the above-noted and other shortcomings of the prior art by providing a novel and improved hydraulic digital stepper actuator. The actuator constructed in accordance with the present invention incrementally displaces a movable member a predetermined distance independently of the magnitude of the force exerted by a pressurizing substance used to move the movable member. More particularly, the present invention achieves accurate, repeatable incremental displacement of the movable member because of the interrelationship of a plurality of ports and openings included in the apparatus constructed according to the present invention.

The present invention achieves precise incremental displacement without any electrical feedback to the primary controlling means. Instead, precise positioning is dependent on the size and separation of the ports and openings included within the apparatus. However, the present invention does include a pressure feedback means to compensate overshoot whereby the movable member stops at the appropriate location.

The present apparatus controls the movement of the movable member by applying a pressurizing substance through particular ones of the ports and openings in response to a cyclical sequence of electrical signals, such as a Gray Code sequence of digital signals. By varying the time between each signal within the sequence of signals, the speed of movement of the movable member is controlled.

Furthermore, although the magnitude of force exerted by the pressurizing substance applied through the ports and openings does not affect the distance the movable member is displaced, the magnitude of the force exerted thereby does permit high levels of force, as well as other levels of force, to be exerted by the movable member on whatever object the movable member is associated with.

Broadly, the present invention provides an apparatus for converting pressure into motion comprising a movable member responsive to pressure and means for supplying a first flow of pressurizing substance to a selected one of a plurality of selectable areas on the movable member until the movable member has moved a predetermined distance. The plurality of selectable areas on the movable member includes a first opening formed therein. The apparatus further comprises means for releasing a second flow of pressurizing substance from a second opening formed in the movable member when the supplying means supplies the first flow of pressurizing substance to the first opening formed in the movable member. The apparatus also includes means for controlling the supplying means and the releasing means. The controlling means includes means for generating a coded sequence of control signals.

From the foregoing it is a general object of the present invention to provide a novel and improved hydraulic digital stepper actuator. Other and further objects, features and advantages of the present invention will be readily apparent to those skilled in the art when the following description of the preferred embodiments is read in conjunction with the accompanying drawings.

Figure 3:
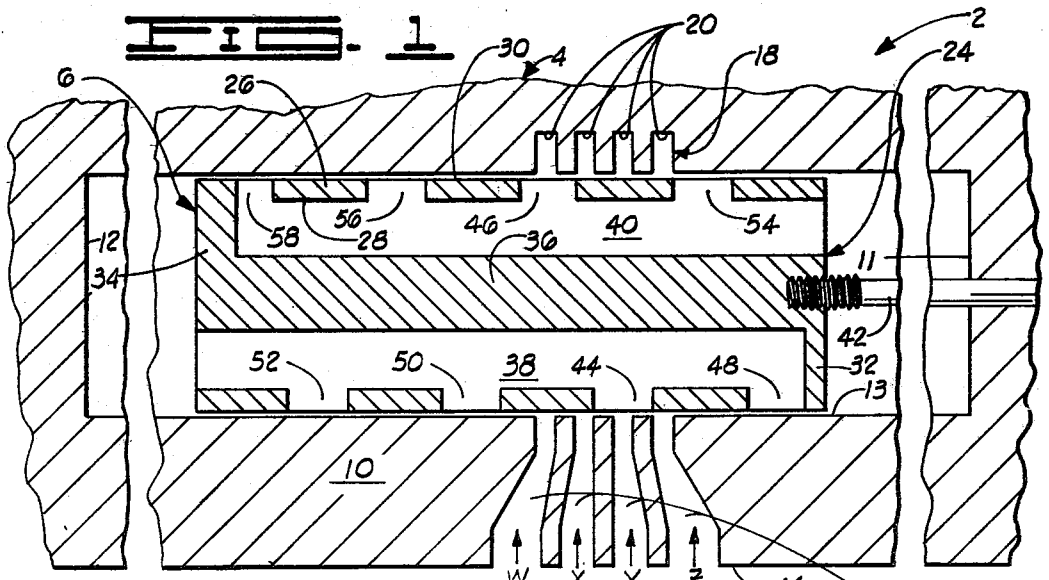
FIG. 3 is a schematic illustration of a preferred embodiment of the present invention showing the movable member in a first position.
Figure 5:
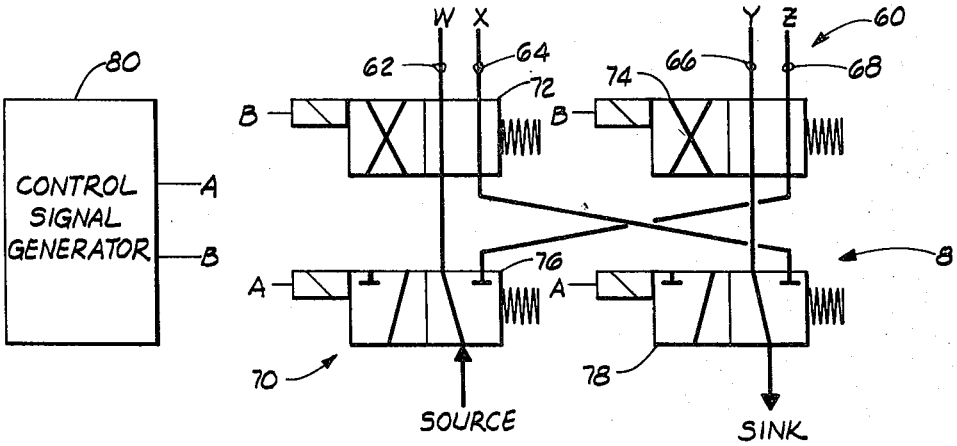
FIG. 5 is a schematic diagram of a first preferred embodiment of the valve means of the present invention.
Figure 6:
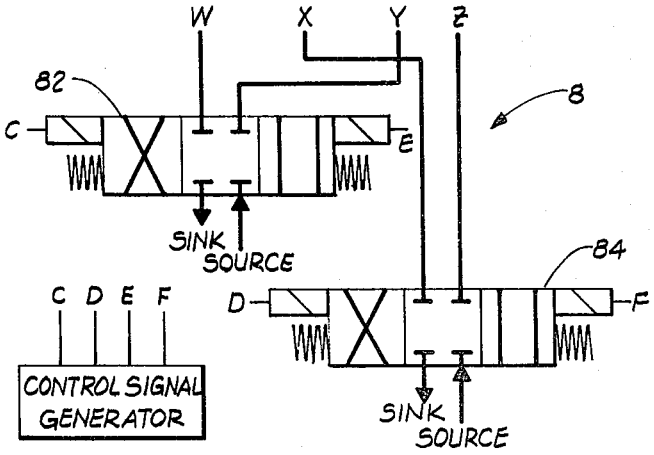
FIG. 6 is a schematic illustration of a second preferred embodiment of the valve means of the present invention.
Figure 7:
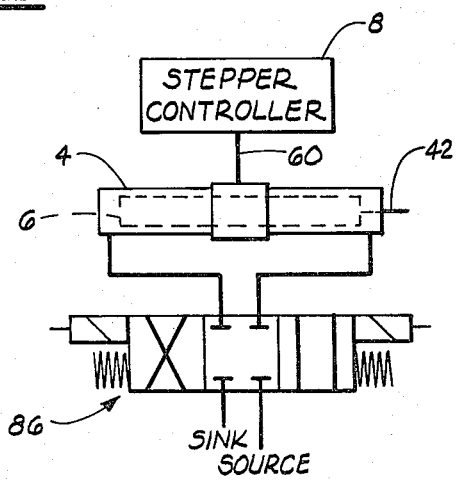
FIG. 7 is a schematic illustration of another embodiment of the present invention.

With reference to the drawings an apparatus for converting pressure into motion, and particularly into limited motion, constructed in accordance with the present invention will be described. In FIG. 3 the apparatus, generally indicated by the reference numeral 2, includes a housing 4 and a movable member 6 movably disposed within the housing 4. Connected to the housing 4 is a control means 8 for controlling the flow of a pressurizing substance (such as an incompressible hydraulic material or any other suitable substance) from a pressure source (such as a tank and pump system) to the housing 4 and the movable member 6 and from the housing 4 and movable member 6 to a pressure sink (such as the tank or a sump). Embodiments of the control means are shown in FIGS. 5–7.

The housing 4 includes a wall 10 which preferably has a cylindrical shape and further includes a first closed end 11 and a second closed end 12. The wall 10 has an interior surface 13 and an exterior surface 14.

The housing 4 also includes pressurizing substance channeling means 16 disposed in the wall 10 thereof. The channeling means 16 directs the pressurizing substance from the pressure source to the movable member 6 as subsequently described. The channeling means 16 also directs the pressurizing fluid from the movable member 6 to the pressure sink also as subsequently described. The channeling means 16 also directs the pressurizing fluid from the movable member 6 to the pressure sink also as subsequently described. In FIG. 3 the channeling means 16 is shown to particularly include a plurality of ports 18. In the embodiment shown in the figures there are four ports identified by the letters W, X, Y and Z. The ports are defined by a plurality of grooves 20 formed in spaced relationship to each other on the interior surface 13 of the wall 10 and by a plurality of holes 22 formed through the wall 10 so that each hole extends from a respective one of the grooves 20 to the exterior surface 14 of the wall 10.

This porting system provides means for supplying a first flow of the pressurizing substance to a selected one of a plurality of selectable areas on the movable member 6 until the movable member has moved a predetermined distance in a number of predetermined increments in relation to the housing 4 within which the movable member 6 is movably disposed.

The movable member 6 is shown in FIG. 3 to include a double-acting piston 24 movably disposed within the housing 4 for sliding engagement along the interior surface 13. The piston 24 includes a side wall 26 having an inner surface 28 and an outer surface 30. The piston 24 also includes a first end wall 32 closing a first portion of a first end of the side wall 26 but leaving a second portion of the first end open. The piston 24 further includes a second end wall 34 closing a first portion of a second end of the side wall 26 but leaving a second portion of the second end open. Additionally the piston 24 includes a central wall 36 extending from the first end wall 32 to the second end wall 34 and from a first region of the inner surface 28 of the side wall 26 to a second region of the inner surface 28 of the side wall 26 so that a first chamber 38 extending from the first end wall 32 to the open portion of the second end of the side wall 26 and a second chamber 40 extending from the second end wall 34 to the open portion of the first end of the side wall 26 are formed. Connected to the first end wall 32 is a connecting rod 42 which extends through a bore in the first closed end 11 of the housing 4 for engaging the workpiece to be incrementally positioned by the present invention.

The movable member 6, which is responsive to pressure, includes receiving means for receiving the pressurizing substance from the pressure source. The receiving means includes the plurality of selectable areas to which the supplying means directs the first flow of pressurizing substance for moving the movable member 6 with respect to the housing. As shown in FIG. 3 these areas include a first opening 44 and a second opening 46. Other openings 48, 50, 52, 54, 56 and 58 are shown in FIG. 3 to be included within the movable member 6, and more particularly, the first, second and remaining openings 44–58 include a first plurality of apertures extending from the outer surface 30 of the side wall 26 to the inner surface 28 thereof for communicating with the first chamber 38 and a second plurality of apertures extending from the outer surface 30 of the side wall 26 to the inner surface 28 thereof for communicating with the second chamber 40. In FIG. 3, the apertures 44 and 48–52 constitute the first plurality, and the apertures 46 and 54–58 constitute the second plurality. Each aperture of the first plurality of apertures is equidistantly spaced from each adjacent one of the first plurality of apertures, and each aperture of the second plurality of apertures is centered on a line perpendicularly bisecting a line extending between the centers of a respective set of two adjacent apertures of the first plurality of apertures. In the embodiment shown in the drawings the first plurality of apertures is positioned on the side wall 26 of the movable member 6 diametrically opposite the second plurality of apertures. Also as shown in the drawings, the first plurality of apertures is disposed in a row along a first portion of the piston 24 in communication with the first chamber 38, and the second plurality of apertures is aligned in a row along a second portion of the piston 24 in communication with the second chamber 40.

The openings 44–58 formed in the movable member 6 and the ports 18 of the housing 4 provide means for releasing a second flow of the pressurizing substance from an opening communicating with one of the chambers 28 or 40 when the supplying means supplies the first flow of pressurizing substance to another opening communicating with the other of the two chambers.

The movable member 6 and the housing 4 are positioned with respect to each other whereby the ports 18 of the channeling means of the housing 4 are disposed adjacent the movable member 6 for sequentially registering with the openings 44–58 formed in the movable member 6, such as the first opening 44 and the second opening 46 as shown in FIG. 3, as the movable member 6 is incrementally moved so that the pressurizing substance can be supplied through the channeling means to one of the registering openings to thereby move the movable member 6 in either of the two directions longitudinally through the housing 4. More particularly, the movable member 6 is disposed within the housing 4 so that a first one of the openings registers with one of the ports of the housing 4 for communicating the first flow of pressurizing substance from the pressure source to the movable member 6 through the first opening when the pressure source is connected to that port registering with the first opening and so that a second one of the openings registers with another of the ports of the housing 4 for communicating the second flow of the pressurizing substance from the movable member 6 to the pressure sink through the second opening when the pressure sink is connected to that port registering with the second opening. By controlling the ports through which the first and second flows are directed, the movable member 6 is caused to move with respect to the housing 4.

The control of the communication of the first and second flows of pressurizing substance with the ports and openings is achieved by means of the control means 8. Generally, the control means 8 provides means for controlling the supplying means and the releasing means whereby the first and second flows of pressurizing substance are appropriately directed to and from the housing 4 and movable member 6. With reference to FIGS. 5–7 preferred embodiments of the control means 8 will be described.

FIG. 5 schematically illustrates that the control means 8 includes conduit means 60 for connecting the ports 18 of the housing 4 to the pressure source and the pressure sink. The conduit means 60 includes a plurality of ducts schematically illustrated by numbered lines 62, 64, 66 and 68. Each duct is associated with a respective one of the ports as indicated by the labeling of the ducts with a letter corresponding to its respective port shown in FIGS. 3 and 4.

Connected within the conduit means 60 is a valve means 70 for appropriately connecting respective ones of the ducts 62–68 within the conduit means 60 to either the source or the sink of pressurizing substance or to a blocking means as subsequently discussed. The valve means 70 is used to connect a first flow of pressurizing substance from the pressure source to one of the ports 18 and to connect a second flow of pressurizing substance from another of the ports 18 to the pressure sink. As shown in the FIG. 5 embodiment the valve means 70 includes four interconnected two-position valves 72, 74, 76 and 78 having respective solenoid-operated valve elements positioned therein. The solenoids of the valves shown in FIG. 5 are controlled by excitation signals generated by a control signal generator 80. More particularly, the valves 72–78 and ducts 62–68 of the FIG. 5 embodiment are interconnected so that the valves are responsive to two-digit Gray Code excitation signals for sequentially connecting each port within a respective set of two ports of the ports 18 to a respective one of the pressure source, the pressure sink, or the blocking means.

The control signal generator 80 provides means for generating a coded sequence of control signals, such as a sequence of two-digit Gray Code excitation signals or a sequence of four-variable excitation signals, as subsequently described or any other sequence of excitation signals. Through the creation of such control signals the control signal generator 80 provides means for operating the valve means 70 in a predetermined sequence so that the pressure source, the pressure sink, and the blocking means are sequentially communicated with respective ones of the ports 18 which are registered with respective ones of the openings 44–58 of the movable member 6 whereby the movable member 6 moves in incremental steps. In other words, the control signal generator 80 provides means for operating the valve means 70 so that the first flow of pressurizing substance directed to one of the ports in register with one of the apertures of one of the first or second rows of apertures and so that the second flow of pressuring substance is received from another of the ports in register with one of the apertures of the other of the first or second rows of apertures. Specifically, the control signal generator 80 preferably is a microcomputer or other apparatus for providing digital output signals.

The embodiment of the control means 8 shown in FIG. 6 includes two three-position valves 82 and 84 responsive to four-variable excitation signals which are generated by the control signal generator 80 associated therewith for sequentially connecting each port within a respective set of two ports of the ports 18 to a respective one of the pressure source, the pressure sink, or the blocking means.

FIG. 7 shows that the control means 8 further includes emergency actuation valve means 86 having a pressurizing substance conducting duct connected to each end of the housing 4 so that the piston can be rapidly moved in either direction to quickly extend or retract the connecting rod 42 connected thereto.

Figure 1:
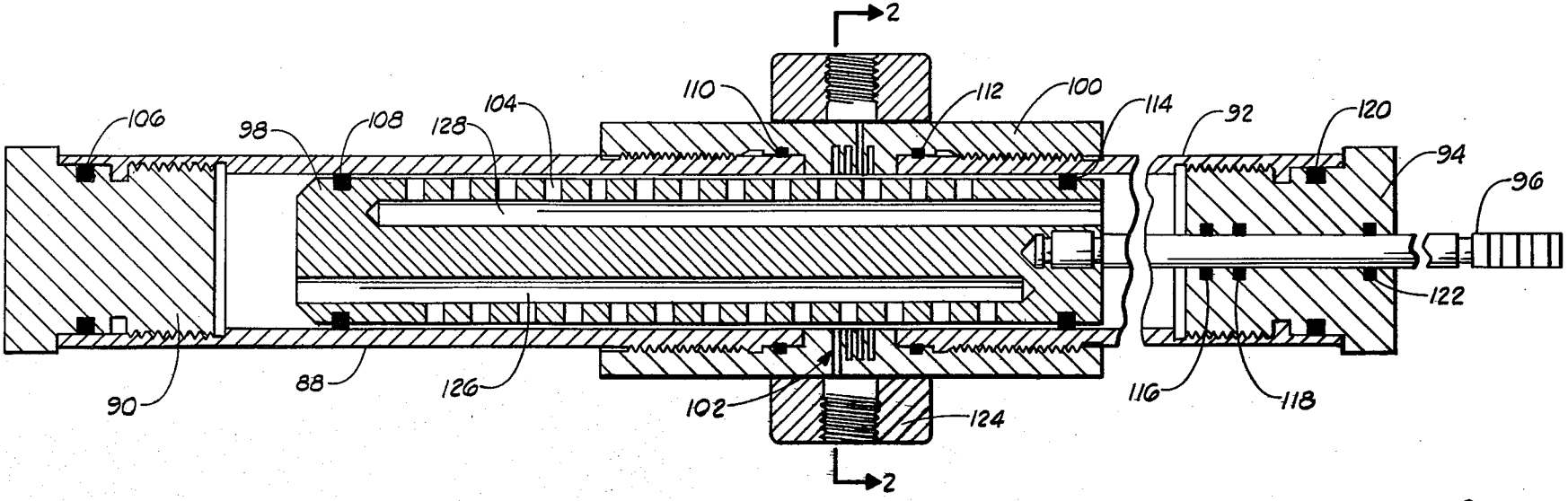
FIG. 1 is a sectional view of a specific embodiment of the present invention.
Figure 2:
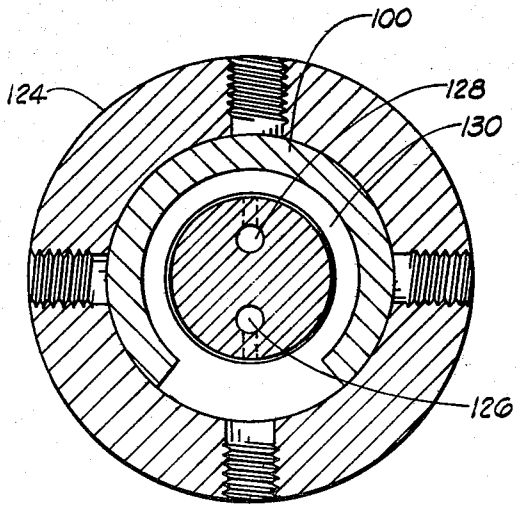
FIG. 2 is a cross-sectional view taken along the line 2—2 shown in FIG. 1.

FIGS. 1 and 2 disclose a specific embodiment of the present invention containing various ones of the elements previously discussed. More particularly, the apparatus includes a first housing section 88 having a first closed end 90 and a second housing section 92 having a second closed end 94 through which a connecting rod 96 is slidably disposed. The connecting rod 96 is connected to a piston 98 contained within the cylinder defined by the first and second housing sections 88 and 92. The first and second housing sections 88 and 92 are joined by a housing coupling sleeve 100 in which are formed ports 102 for conducting the pressurizing substance to and from respective ones of a plurality of apertures 104 formed in the piston 98. FIG. 1 further shows several O-rings 106, 108, 110, 112, 114, 116, 118, 120 and 122 positioned for effecting fluid-tight seals between the joined elements of the apparatus shown therein.

The apparatus disclosed in FIG. 1 further includes a coupling collar 124 by which a control means, including appropriate valve means, conduit means, and signal generator means, are connected to the assembled housing sections 88 and 92 and coupling sleeve 100.

FIG. 2 discloses that a first chamber 126 and a second chamber 128 formed within the piston 98 have circular cross-sections. FIG. 2 further discloses a groove 130 of one of the ports 102 formed in the housing coupling sleeve 100.

As will be apparent upon an examination of the structure shown in FIG. 1, as the pressurizing substance is directed into one of the chambers 126 or 128 through one of the apertures 104 formed in the piston 98 and through the appropriate one of the ports 102 formed in the housing coupling sleeve 100 and the pressurizing substance from the other of the chambers 126 and 128 is released through the appropriately aligned aperture and port, the piston 98 will move longitudinally through the cylinder defined by the housing assembly to thereby incrementally move the connecting rod 96 and the workpiece connected thereto. This operation will be more specifically described with reference to FIGS. 3–6.

Before the operation is more specifically described, however, the preferred dimensional relationships among the various elements will be considered. For the embodiments disclosed in FIGS. 3–6, the desired length of each increment by which the piston 24 and the connecting rod 42 are to be moved is designated as a distance S. For example, S might equal one-sixteenth inch. With a step size of S, each of the apertures 44–58 formed in the piston 24 has a diameter 1.5 S and the apertures are spaced on centers separated a distance of 4 S. With such a center spacing, this makes the width of the portion of the side wall 26 between each adjacent aperture have a length of 2.5 S. With the apertures and separating portions having these proportions, each aperture communicating with one of the chambers is to be positioned exactly in the middle of a respective set of two apertures communicating with the other chamber.

The four ports W, X, Y and Z are centered between the ends 11 and 12 of the cylinder defined by the housing 4. Each of the grooves 20 defining a portion of each port is 0.5 S wide, and adjacent grooves are spaced on 1.0 S centers. That is, the portion of the housing 4 separating each of the grooves 20 is 0.5 S wide.

By using the valve means disclosed in FIGS. 5 and 6, or another suitable valve means, each of the ports 18 can be connected to the pressure source, the pressure sink, or the blocking means. The blocking means is provided by merely plugging, capping, or otherwise closing the appropriate end of the respective duct to be blocked. Whether a particular port is connected to the pressure source, the pressure sink or a blocking means is determined by the positioning of the particular valves as controlled by the control signal generator 80 and the excitation signals generated thereby.

The operation of the apparatus can be explained by the following steps. Initially, it will be assumed that the piston 24 is located with the opening or aperture 44 in register with port Y as shown in FIG. 3. To move piston 24 to the right, port Y must be connected to the pressure source so that a first flow of the pressurizing substance will be permitted to enter into the first chamber 38 through the first aperture 44 whereby the substance acts through the first chamber 38 and against the second closed end 12 of the housing 4. Simultaneously, the port W must be connected to the pressure sink so that pressurizing substance contained within the second chamber 40 can be released in a second flow through the second opening 46 and port W into the pressure sink or tank. Ports X and Z should be blocked at this time so that no pressurizing substance flows therethrough. This connection of the valves 72–78 to the ports W, X, Y and Z moves the piston 24 to the right until the trailing edge of the first opening 44 passes the port Y thereby shutting off the first flow of pressurizing substance therethrough. This places the piston 24 in the position relative to the ports 18 shown in FIG. 4.

Figure 4:
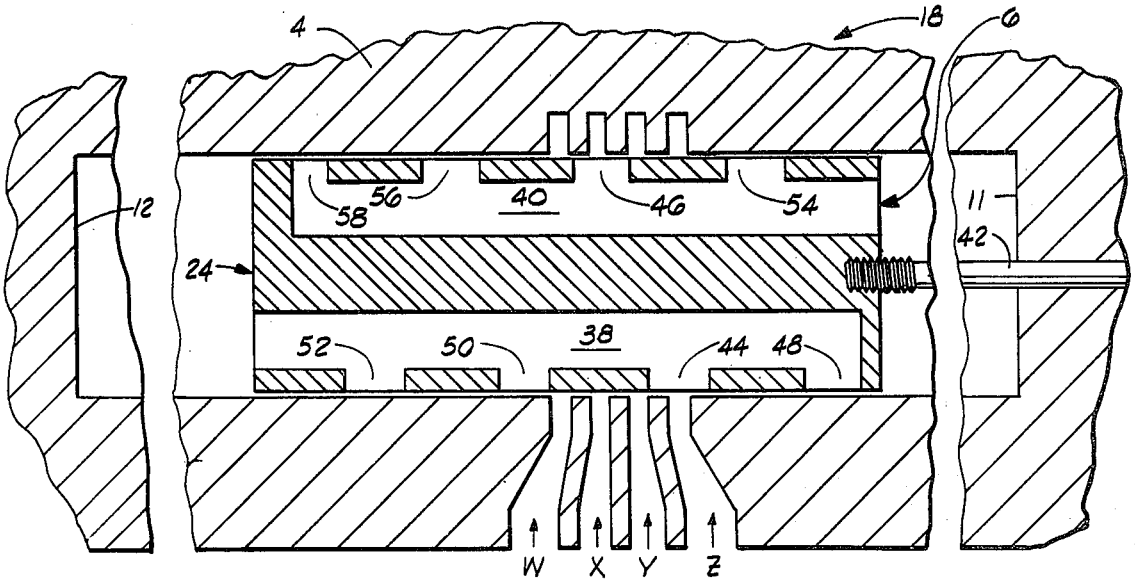
FIG. 4 is a schematic illustration of a preferred embodiment of the present invention showing the movable member in a second position.

In FIG. 4 it is to be noted that should the piston 24 overshoot the port Y prior to stopping, the first flow of pressurizing substance through port Y will enter the second chamber 40 through the second aperture 46 and the second flow of pressurizing substance will come from the first chamber 38 through the aperture 50 adjacent port W. Therefore, the piston is moved to the left to compensate for the overshoot. This provides pressurized feedback to precisely position the piston 24 and thereby move the piston 24 and associated connecting rod 42 only the desired increment. This precise positioning permits each increment to be repeatably obtained.

Further movement of the piston 24 to the right can be achieved by next pressurizing (i.e., connecting the pressure source thereto) port Z while tanking (i.e., connecting the pressure sink thereto) port X. Ports W and Y should be blocked during this movement.

Further movement is effected by pressurizing port W, tanking port Y and blocking ports X and Z. The fourth step is achieved by pressurizing port X, tanking port Z and blocking the other two ports.

By cyclically performing these steps in this order moves the piston 24 to the right, whereas performing the cycle in the reverse order moves the piston 24 to the left. That is, to move the piston to the left, the pressure source must be communicated with respective ones of the apertures 46, 54, 56 and 58 and the second chamber 40, and the pressure sink must be communicated with respective ones of the apertures 44, 48, 50 and 52 and the first chamber 40.

It is apparent that the distance which the piston 24 moves in each increment is the distance across a single port and a single separating portion of the housing 4. Based on the previous dimensions, this gives the desired incremental step size of S. The speed at which the movement is effected depends upon the speed at which the excitation signals are generated and applied to the valve means to thereby change the different connections among the pressure source, pressure sink, blocking means and ports.

As previously discussed, the pressure feedback prevents overshoot. Also preventing overshoot is the relationship between the ports 18 and apertures 44–58 whereby the aperture through which the pressurizing substance is being input gradually closes the pressurizing port to thereby cause deceleration of the piston 24 as it is moved within the housing 4.

As mentioned above the actuation of the apparatus is controlled by a cyclical sequence of excitation signals generated by the control signal generator means 80 for operating the valves in the valve means to establish different ducting connections to the various ports. Preferably these signals are digital signals representing either a first state or a second state. For the four-port device disclosed in the drawings, each cycle consists of four steps involving the application of the pressure source and the pressure sink to four different two-port combinations. To distinguish each of these four steps, at least two excitation signals are required as represented, for example, by the letters A and B in FIG. 5. By using these two signals four different combinations of control signals can be generated to operate the valves so that four different ducting combinations between the pressure source, pressure sink and blocking means and the ports W, X, Y and Z can be effected. By arranging the sequence of the four combinations in the Reflective Binary Code (also known as the Gray Code), a truth table as follows can be established:

| PORT | | | | EXCITATION SIGNAL | |
|---|---|---|---|---|---|
| W | X | Y | Z | A | B |
| P | M | T | M | 0 | 0 |
| M | P | M | T | 0 | 1 |

-continued

| PORT | | | | EXCITATION SIGNAL | |
|---|---|---|---|---|---|
| W | X | Y | Z | A | B |
| T | M | P | M | 1 | 1 |
| M | T | M | P | 1 | 0 |

In the preceding table P represents that the respective port is to be connected to the pressure source, T indicates that the respective port is to be connected to the pressure sink and M designates those ports to be connected to the blocking means.

From this table the following logic expressions are derived:

$$W=PA'B'+TAB+M[A\oplus B]$$

$$X=PA'B+TAB'+M[A\equiv B]$$

$$Y=PAB+TA'B'+M[A\oplus B]$$

$$Z=PAB'+TA'B+M[A\equiv B]$$

Where "$\oplus$" and "$\equiv$" designate EXCLUSIVE OR and COINCIDENCE functions, respectively.

Solving for P and T yields:

$$P=WA'B'+XA'B+YAB+ZAB'$$

$$T=WAB+XAB'+YA'B'+ZA'B$$

These last two expressions are implemented by means of the four-valve circuit shown in FIG. 5 to appropriately control the present invention.

Other excitation schemes can also be derived. For example, the four-variable excitation approach shown in the following truth table can be used:

| PORT | | | | EXCITATION SIGNAL | | | |
|---|---|---|---|---|---|---|---|
| W | X | Y | Z | C | D | E | F |
| P | M | T | M | 1 | 0 | 0 | 0 |
| M | P | M | T | 0 | 1 | 0 | 0 |
| T | M | P | M | 0 | 0 | 1 | 0 |
| M | T | M | P | 0 | 0 | 0 | 1 |

Assuming that the actuating signals cannot occur together, expressions for W, X, Y and Z are developed as follows:

$$W=PC+TE+M[D+F]$$

$$X=PD+TF+M[C+E]$$

$$Y=PE+TC+M[D+F]$$

$$Z=PF+TD+M[C+E]$$

These expressions are shown implemented with the two blocked-centered, double-solenoid valves 82 and 84 shown in FIG. 6.

It is to be noted that although the preferred embodiment shown in the drawings includes four ports, any $2^n$, n being an integer greater than 1, number of ports may be used. Increasing the number of ports increases the resolution with which the movable member 6 can be moved, but also causes the manufacturing and machining of the apparatus to be more difficult. When $2^n$ ports are used and binary control signals and two-position valves are used, the operating means includes means for generating at least n-digit excitation signals, such as an n-digit Gray Code, and the valve means includes $2^n$ interconnected two-position valves which are responsive to the n-digit excitation signals. Other types of operating means and valve means can be used for different types of control signals and valves.

Thus the present invention of a hydraulic digital stepper actuator is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. An apparatus for converting pressure, exerted by a pressurizing substance between a pressure source and a pressure sink, into increments of displacement, each increment having a length S, said apparatus comprising:

a housing including a wall having four grooves defined in spaced relationship to each other on an interior surface of said wall and said wall further having four holes defined therethrough so that each hole extends from a respective one of the grooves to an exterior surface of said wall, said grooves and holes thereby defining four ports of said housing, each of said grooves being 0.5 S wide and being spaced from each adjacent groove on centers spaced 1.0 S; and a double-acting piston disposed for movement in said housing in response to the pressurizing substance, said piston including:

a side wall having an inner surface and an outer surface and further having a first plurality of apertures and a second plurality of apertures defined in said side wall so that each of said apertures extends from the inner surface to the outer surface, each of said apertures having a diameter of 1.5 S with each aperture of said first plurality of apertures being spaced on a center separated a distance of 4.0 S from a center of each adjacent aperture of said first plurality of apertures and with each aperture of said second plurality of apertures being spaced on a center separated a distance of 4.0 S from a center of each adjacent aperture of said second plurality of apertures, said first plurality of apertures including a first aperture and a second aperture and said second plurality of apertures including a third aperture, wherein:

said third aperture is defined in said side wall so that said third aperture registers with a first one of said ports when said first aperture registers with a second one of said ports and further so that said third aperture registers with said second one of said ports when said first aperture overshoots in a first direction said second one of said ports; and said second aperture is defined in said side wall so that said second aperture registers with said first one of said ports when said first aperture overshoots in said first direction said second one of said ports, said first, second and third apertures thereby providing feedback means for precisely positioning said piston relative to said housing;

a first end wall closing a first portion of a first end of said side wall and leaving a second portion of said first end open;

a second end wall closing a first portion of a second end of said side wall and leaving a second portion of said second end open; and a central wall extending from said first end wall to said second end wall and from a first region of the inner surface of said side wall to a second region of the inner surface of said side wall so that a first chamber extending from the first end wall to the open portion of the second end of said side wall and a second chamber extending from said second end wall to the open portion of the first end of said side wall are formed, wherein said first plurality of apertures communicates with said first chamber and wherein said second plurality of apertures communicates with said second chamber.

2. An apparatus as defined in claim 1, wherein:

said first plurality of apertures is disposed in a row along a first portion of said side wall;

said second plurality of apertures is disposed in a row along a second portion of said side wall; and each aperture of said second plurality of apertures has its center on a line perpendicularly bisecting a line extending between the centers of a respective set of two adjacent apertures of said first plurality of apertures so that said third aperture is disposed between said first and second apertures but spaced circumferentially therefrom.

3. An apparatus as defined in claim 2, wherein said housing includes:

a first housing section having a first closed end and a first open end;

a second housing section having a second closed end and a second open end; and a housing coupling sleeve for coupling said first and second housing sections so that said first and second open ends are directed towards each other for permitting said piston to move therebetween, said housing coupling sleeve including said wall having said ports defined therethrough.

4. An apparatus as defined in claim 3, further comprising a coupling collar associated with said housing coupling sleeve for connecting said ports with the pressure source and the pressure sink.

5. An apparatus as defined in claim 4, wherein:

said holes which in part define said four ports are spaced circumferentially from each other around said housing coupling sleeve; and said coupling collar includes four passageways spaced circumferentially from each other so that each of said four passageways communicates with a respective one of said holes.

6. An apparatus as defined in claim 1, wherein said housing includes:

a first housing section having a first closed end and a first open end;

a second housing section having a second closed end and a second open end; and a housing coupling sleeve for coupling said first and second housing sections so that said first and second open ends are directed towards each other for permitting said piston to move therebetween, said housing coupling sleeve including said wall having said ports defined therethrough.

7. An apparatus as defined in claim 6, further comprising a coupling collar associated with said housing coupling sleeve for connecting said ports with the pressure source and the pressure sink.

8. An apparatus as defined in claim 7, wherein:

said holes which in part define said four ports are spaced circumferentially from each other around said housing coupling sleeve; and said coupling collar includes four passageways spaced circumferentially from each other so that each of said four passageways communicates with a respective one of said holes.

* * * * *